United States Patent [19]

Upton et al.

[11] Patent Number: 4,692,751

[45] Date of Patent: Sep. 8, 1987

[54] RAIN DETECTOR

[76] Inventors: Gain Upton, R.R. 1, Box 61, Flora, Ind. 46929; George Spector, 233 Broadway RM 3815, New York, N.Y. 10007

[21] Appl. No.: 902,771

[22] Filed: Sep. 2, 1986

[51] Int. Cl.[4] ..... H01H 35/00; G08B 21/00

[52] U.S. Cl. ..... 340/602; 200/61.04

[58] Field of Search ..... 200/52 R, 61.04–61.07, 200/81.9 R, 85 R; 340/601, 602, 603, 604

[56] References Cited

U.S. PATENT DOCUMENTS

| | | | |
|---|---|---|---|
| 1,213,642 | 1/1917 | Hoeft | 200/81.9 R |
| 1,280,116 | 9/1918 | Troiano | 200/61.04 X |
| 2,171,329 | 8/1939 | Boone | 200/61.05 |
| 2,432,367 | 12/1947 | Andresen | 200/61.04 |
| 2,443,687 | 6/1948 | Marquard | 200/61.04 |
| 2,769,872 | 11/1956 | Clark | 200/61.05 |
| 2,856,476 | 10/1958 | Kaiser et al. | 200/61.04 |
| 3,210,492 | 10/1965 | Hayes | 200/61.04 |

FOREIGN PATENT DOCUMENTS

| | | | |
|---|---|---|---|
| 2523085 | 12/1976 | Fed. Rep. of Germany | 200/61.07 |

*Primary Examiner*—J. R. Scott

[57] ABSTRACT

A rain detector adapted to be mounted on a window sill that is activated in a pulsating manner caused by the rain hitting the detector thus giving the detector a distinctive alarm to notify a person to close the window, wherein the detector comprises a movable spring supported plate with an electrical contact spaced from a fixed plate with an opposing electrical contact whereby rain drops activate the movable plate to cause engagement of said contacts thus activating a pulsating alarm.

4 Claims, 3 Drawing Figures

RAIN DETECTOR

BACKGROUND OF THE INVENTION

The instant invention relates generally to signal devices and more specifically it relates to a rain detector.

Numerous signal devices have been provided in prior art that are adapted to indicate that it has begun to rain. For example, U.S. Pat. Nos. 1,213,642; 2,171,329 and 2,856,476 all are illustrative of such prior art. While these units may be suitable for the particular purpose to which they address, they would not be as suitable for the purpose of the present invention as heretofore described.

SUMMARY OF THE INVENTION

A primary object of the present invention is to provide a rain detector that will overcome the shortcomings of the prior art devices.

Another object is to provide a rain detector that is mounted on a window sill which will notify a person within a building of rain so that the window can be closed.

An additional object is to provide a rain detector which will be activated in a pulsating manner caused by the rain hitting the detector this giving the detector a distinctive alarm.

A further object is to provide a rain detector that is simple and easy to use.

A still further object is to provide a rain detector that is economical in cost to manufacture.

Further object of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
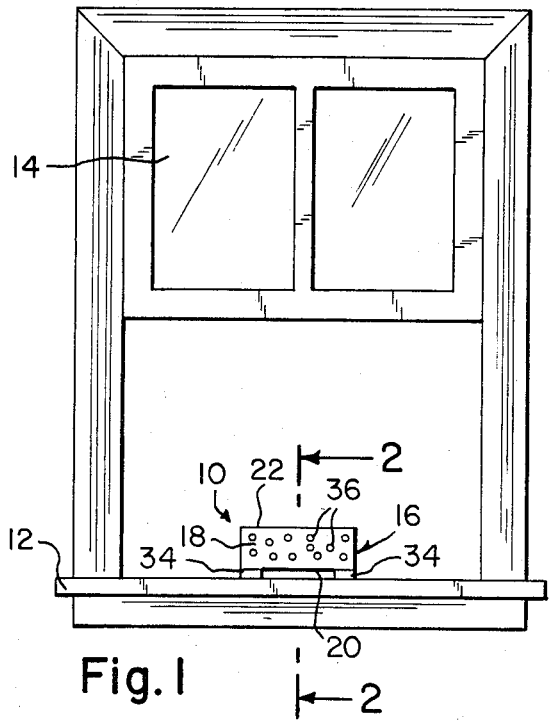
FIG. 1 is a front view of a window with the invention installed on the sill.
Figure 2:
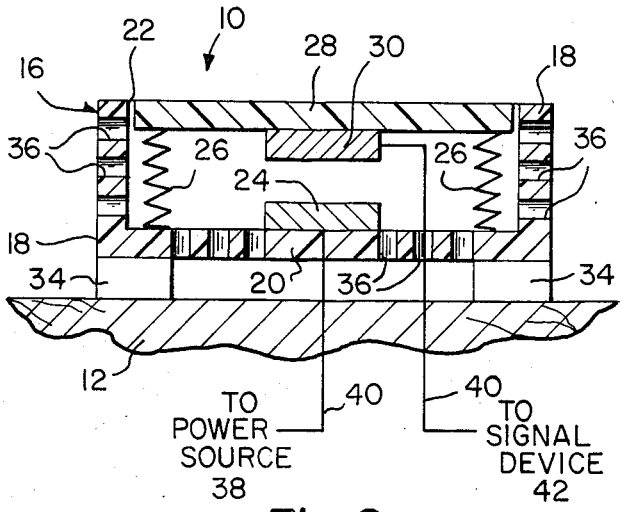
FIG. 2 is an enlarged cross sectional view taken along line 2—2 in FIG. 1 showing the internal construction thereof.
Figure 3:
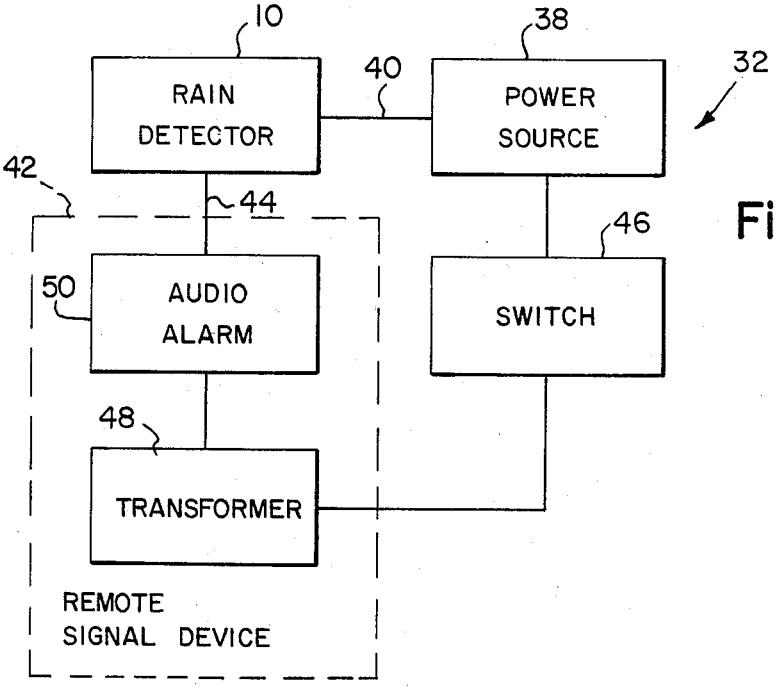
FIG. 3 is a diagrammatic block diagram showing the electrical circuit.

Turning now descriptively to the drawings, in which similar reference characters denote similar elements throughout the several views, FIGS. 1 through 3 illustrates a rain detector 10 to be placed on a sill 12 of an open window 14. The detector 10 includes an insulated housing 16 that has upright walls 18, a bottom wall 20 and an open top 22. A first contact member 24 is mounted to the bottom wall 20 within the housing 16. A pair of springs 26 are mounted vertically to the bottom wall 20 within the housing at opposite sides of the first contact member 24. An insulated plate 28 is mounted on the springs 26 so as to vibrate within the open top 22 of the housing 16. A second contact member 30 is mounted to underside of the plate 28 and is spaced apart from the first contact member 24. An alarm circuit 32 is electrically connected to the first and second contact members 24, 30. Rain drops falling on the plate 28 will cause the plate to vibrate up and down within the open top 22 of the housing 16 allowing the first and second contact members 24, 30 to momentariy touch each other producing a plusating action through the alarm circuit 32.

The rain detector 10 further contains a plurality of feet 34, each of which is mounted to underside of the bottom wall 20 of the housing 16 so that the housing will be suspended above the sill 12 of the window 14. The upright walls 18 and the bottom wall 20 of the housing has a plurality of perforations 36 to allow rain water to drain therefrom.

The alarm circuit 32 includes a power source 38, such as a battery or house current is electrically connected via wire 40 to the first contact member 24. A remote signal device 42 is electrically connected via wire 44 to the second contact member 30. A switch 46 is electrically connected between the power source 38 and the remote signal device 42 so that the remote signal device may be manually turned on and off whenever desired. The remote signal device 42 includes a transformer 48 and an audio alarm 50 such as a bell, buzzer and the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A rain detector to be placed on a sill of an open window, said detector comprising:

(a) an insulated housing having a plurality of upright walls forming a walled enclosure, a bottom wall and an open top;

(b) a first contact member mounted to said bottom wall within said housing;

(c) a pair of springs mounted vertically to said bottom wall within said housing at opposite sides of said first contact member;

(d) an insulated plate mounted on said springs so as to vibrate within the cavity defined by said upright walls of said housing;

(e) a second contact member mounted to underside of said plate and being spaced apart from said first contact member; and (f) an alarm circuit electrically connected to said first and second contact members so that rain drops falling on said plate will cause said plate adjacent to said open top to vibrate up and down within the cavity defined by said upright walls of said housing allowing said first and second contact members to momentarily touch each other producing a pulsating action through said alarm circuit.

2. A rain detector as recited in claim 1, further comprising:

(a) a plurality of feet, each of which is mounted to underside of said bottom wall of said housing so that said housing will be suspended above said sill of said window; and (b) said upright walls and said bottom wall of said housing having a plurality of perforations to allow rain water to drain therefrom.

3. A rain detector as recited in claim 2, wherein said alarm circuit includes:

(a) a power source electrically connected to said first contact member;

(b) a remote signal device electrically connected to said second contact member; and (c) a switch electrically connected between said power source and said remote signal device so that said remote signal device is manually turned on and off whenever desired.

4. A rain detector as recited in claim 3, wherein said remote signal device includes a transformer and an audio alarm such as a bell or buzzer.

* * * * *